US006185386B1

(12) United States Patent
Noguchi

(10) Patent No.: US 6,185,386 B1
(45) Date of Patent: Feb. 6, 2001

(54) IMAGE FORMING APPARATUS

(75) Inventor: Tomoyuki Noguchi, Fukuoka (JP)

(73) Assignee: Matsushita Electric Industrial Co., Ltd., Osaka (JP)

( * ) Notice: Under 35 U.S.C. 154(b), the term of this patent shall be extended for 0 days.

(21) Appl. No.: 09/216,740

(22) Filed: Dec. 21, 1998

(30) Foreign Application Priority Data

Dec. 25, 1997 (JP) ..... 9-357070

(51) Int. Cl.[7] ..... G03G 15/08

(52) U.S. Cl. ..... 399/49; 399/72; 399/28; 399/53

(58) Field of Search ..... 399/49, 72, 28, 399/29, 39, 50, 51, 53–56

(56) References Cited

U.S. PATENT DOCUMENTS 5,933,680 * 8/1999 Nishimura ..... 399/49

5,991,558 * 11/1999 Emi et al. ..... 399/49

* cited by examiner

*Primary Examiner*—Richard Moses
(74) *Attorney, Agent, or Firm*—Stevens, Davis, Miller & Mosher, L.L.P.

(57) ABSTRACT

An image forming apparatus forms test patches with no lowering of image density and no unevenness of image density. The image forming device includes a unit for generating image data for at least one test patch, an image bearing medium on which a latent image of the test patch is formed being based upon the image data generated by the test patch generating unit, developing unit for supplying toner by means of a developing roller onto the latent image so as to manifest the latent image in order to obtain a toner image, a density sensor for detecting a toner density of a toner image in the manifested test patch, and a compensator for compensating the density, being based upon a value of an output from the density sensor. With this arrangement, the test patch generating unit is adapted to create the test patches after the toner on the developing roller is consumed by a quantity corresponding to one turn of the developing roller.

3 Claims, 9 Drawing Sheets

IMAGE FORMING APPARATUS

BACKGROUND OF THE INVENTION

Field of the Invention

The present invention relates to an image forming apparatus for forming an image having a high degree of image quality.

Description of the Related Art

Conventionally, there have been proposed image forming apparatuses based on various kinds of principles, which are used as output terminals of personal computers, workstations or the like. In particular, color electrophotographing apparatuses utilizing the electrophotography and the laser scanning technology are advantageous in view of its high recording speed and high printing quality, and have been used prosperously as color printers.

In the image forming apparatus of this kind, latent images formed on a photoreceptor belt are successively manifested with the use of developing means so as to form different color toner images which are then transferred from the photoreceptor belt onto an intermediate transfer medium and are synthesized into a color image medium, and the thus obtained color image is transferred in batch onto a paper sheet. Further, as to the developing means, developing means of a one-component developing type have been prosperously used since it is small-sized, inexpensive, reliable and so forth.

Next brief explanation will be made of the one component developing means with reference to FIG. 7.

Referring to FIG. 7, toner 2 is reserved in a toner chamber 1*a* defined in the upper part of a developing tank 1. A pair of toner supply rollers 3*a* for feeding the toner from the toner chamber 1 onto the downstream side thereof are arranged in the lower part of the toner chamber 1, being opposed at their peripheral surfaces to each other so as to be rotated in opposite directions. A toner agitating member 3*b* for preventing congregation of the toner 2 and conveying the same onto the downstream side thereof is provided below the toner supply roller 3*a*.

Below the toner agitating member 3*b*, there is arranged a toner supply roller 3*c* for supplying the toner 2 which has been conveyed by the agitating member 3*b*, onto a developing roller 3*d*. The toner supply roller 3*c* is composed of a metal core and a conductive foamed urethane sponge layer bonded to the core metal. The developing roller 3*d* which is made into contact with the outer peripheral surface of the toner supply roller 3*c* carries thereon the toner 2 transferred from the toner supply roller 3*c*, for manifesting a latent image formed on a photoreceptor belt (which is not shown) by using the toner 2. The developing roller 3*d* is composed of a metal core and a conductive silicone rubber layer in the form of a roll, covering the outer peripheral surface of the metal core, and is adapted to be rotated in the same direction as that of the toner supply roller 3*c*. Further, it is noted that the toner supply roller 3*c* and the developing roller 3*d* are rotatably supported at their opposite ends to the developing tank 3.

A developing blade 4 is provided, abutting against the developing roller 3. This developing blade 4 is composed of a leaf spring member made of stainless steel, phosphor bronze or the like, and an urethane rubber element integrally incorporated with the leaf spring member at one end of the latter, and two rigid metal plates clamping therebetween the other end of the leaf spring member. With this structure, the metal blade 4 is made into contact with the developing roller 3*d*, for forming the toner 2 in a uniformly thin layer on the developing roller 3*d*, and for charging the toner 2.

It is noted here that electrophotographing apparatuses are in general sensitive to environmental variation and variation with time (aging effect) so as to change its input/output characteristics of latent image forming process and developing process and the like, and accordingly the quantity of toner sticking to an image bearing medium, for manifesting a latent image given by the same image data varies so as to cause the image quality of the image to be inferior. In particular, in a color image, there has been raised such a problem that the color reproducibility for synthesizing a plurality of toner colors is low.

Accordingly, there has been proposed, as a countermeasure for preventing occurrence of the above-mentioned image quality deterioration, a density compensating technology such that a plurality of test patches (toner images) having different toner densities are formed on the photosensitive belt or the intermediate transfer medium, as shown in FIG. 8, and the densities of the toner images are detected by a density sensor in order to use the results of the detection for compensating process conditions in a latent image forming process or a developing process.

However, through the provision of the above-mentioned conventional test patches, unused toner on the developing roller passes by the developing blade by several times, and accordingly, the charged value of the toner is increased so that the densities of the images are lowered, resulting in decreased densities and uneven densities in the test patches in the vicinity of the leading end thereof, as shown in FIG. 9. Further, since the density is controlled, being based upon such inferior test patches, the accuracy of the density control itself is also deteriorated, causing deterioration of image quality.

The decrease in the densities of the test patches in the vicinity of the leading end thereof, is caused by such a fact that all toner on the developing roller passes by the developing blade by several times so that the charged value of the toner is increased. Further, the unevenness in density within the test patches, is caused by such a fact that additional toner is applied to a part which is developed as a test patch so as to result in occurrence of difference in charged value between the toner in the part and toner in a part which has not yet been developed (The charged value of the toner in the part having not yet developed is higher than that of the toner having additionally been fed since the former passes by the developing blade by a number of times which is greater than that of the latter).

SUMMARY OF THE INVENTION

Accordingly, an object of the present invention is to provide an image forming apparatus which can create test patches having no decreased density and no unevenness in density.

In order to solve the above-mentioned problems, according to one aspect of the present invention, there is provided an image forming device comprising a test patch creating means for generating image data for at least one test patch, an image bearing medium on which a latent image of the test patch is formed being based upon the image data generated by the test patch creating means, developing means for supplying toner by means of a developing roller onto the latent image so as to manifest the latent image in order to obtain a toner image, a density sensor for detecting a toner density of the toner image of the manifested test patch, and means for compensating the density, being based upon a value of an output from the density sensor. Accordingly, the test patch creating means is adapted to create the test patch after the toner on the developing roller is consumed by a quantity corresponding to one turn of the developing roller.

With this arrangement, since the test patches are created after the toner having a charged value increased from the normal value, the test patches without decreased toner density and uneven toner density can be obtained.

Further, according to the second aspect of the present invention, there is provided an image forming apparatus in which, in addition to the first aspect of the present invention, the test patch creating means creates a plurality of patches in a continuous form with no gaps therebetween in such a way that the test patches are formed after toner having a charged value increased from a normal value is consumed, whereby the test patches without decreased toner density and uneven toner density can be created.

Further, according to the third aspect of the present invention, there is provided an image forming apparatus in which, in addition to the first aspect of the present invention, the test patch creating means forms a plurality of test patches which are spaced from one another so that the distance between the leading edge of a certain test patch and the leading edge of a test patch adjacent to the former is equal to 1/n of the circumferential length of the developing roller, and the test patches are created after toner having a charged value increased from a normal value is consumed, whereby the test patches without decreased toner density and uneven toner density can be obtained.

DESCRIPTION OF THE PREFERRED EMBODIMENTS

Figure 1:
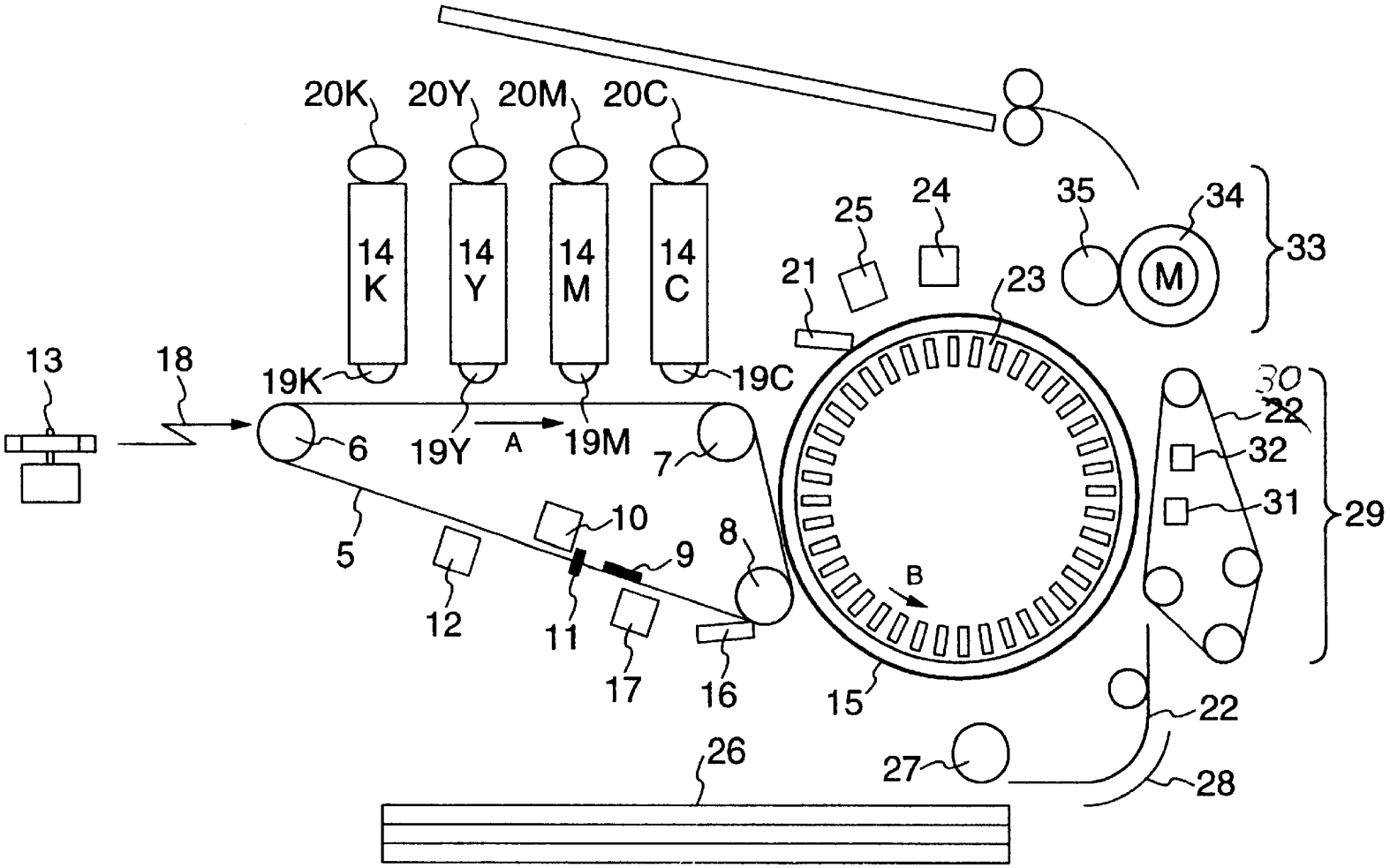
FIG. 1 is a view for explaining an overall structure of an image forming apparatus in a first embodiment of the present invention.

Explanation will be hereinbelow made of specific forms of the present invention with reference to FIGS. 1 top 6. It is noted that the like reference numerals are used to denote the like parts throughout the drawings.

First Embodiment

Referring to FIG. 1, an image forming apparatus comprises a photosensitive belt 5 on which latent images are formed by a laser beam 18, and different color developing units 14K, 14Y, 14M, 14C for developing the latent images formed on the photosensitive images so as to manifest the latent images in order to obtain monocolor images; an image forming medium referred to as an intermediate image transfer medium 15 onto which the monocolor images are successively transferred and synthesized into a multi-color image which is then transferred into a sheet in a batch from the intermediate transfer medium. This image forming apparatus is called an intermediate transfer medium type image forming apparatus. It should be noted that the present invention can be applied to image forming apparatuses other than the intermediate image transfer medium type.

At first, the arrangement around the photosensitive belt 5 in the image forming apparatus will be detailed.

Referring to FIG. 1, the closed-loop photosensitive belt (image bearing medium) 5 is composed of a PET substrate, an aluminum deposited layer, a charge generating layer (CGL), and a charge transfer layer (CTL), and is supported by three belt conveyer layers 6, 7, 8, being turned around by a drive motor (which is not shown) in the direction of the arrow A. A mark 9 for detecting a position of the photosensitive medium is located around a splicing 11 of the photosensitive belt 5 so that it is detected by a photosensitive medium position sensor 10. When an image is formed, the sensor 10 has to go around the splicing 10 of the belt 5, and accordingly, at this time, an output from the sensor 10 for detecting a position of the photosensitive medium position is examined so as to form the image on the belt at a position other than that of the splicing.

As viewed in the direction of the going-around of the photosensitive belt exhibited by the arrow A, a charger 12, an exposure optical system 13, developing units 14K, 14Y, 14M, 14C for colors of black (K), yellow (Y), magenta (M), cyan (C), the intermediate image transfer medium (image bearing medium) 15, a means 16 for cleaning the photosensitive medium, and a discharger 17 are arranged in the mentioned order along the peripheral surface of the photosensitive belt 5.

The charger 12 is composed of a charge wire such as a tungsten wire, a shield panel formed of a metal plate, a grid board and the like (which are not shown). When a negative high voltage is applied to the charge wire, the charge wire effects corona discharge, and if a voltage, for example, −700 V is applied to the grid board, the outer surface of the photosensitive belt 5 is uniformly charged thereover with a negative potential of, for example, about −600 V.

In an exposure optical system 13 which is composed of a laser drive device, a polygon mirror, a lens system, a polygon mirror rotating motor (Scanner motor) and the like (which are not show), an exposure light beam 18 is directed onto the charged photosensitive belt 5 so as to form a latent image. The exposure light beam 18 is subjected to pulse-width modulation by a laser drive circuit (which is not shown) in accordance with an image signal from an image data converting means (which is not shown) in order to form a latent image on the photosensitive belt 5, corresponding to specific color image data.

The developing units 14K, 14Y, 14M, 14C reserve therein toner of black, yellow, magenta, cyan, having developing rollers 19K, 19C, 19M, 19C each made of conductive rubber or the like. When the developing rollers 19K, 19C, 19M, 19C are rotated in a forward direction with respect to the turn-around direction of the photosensitive belt 5, the toner in a thin-layer is applied over the outer surfaces of the developing rollers 19K, 19C, 19M, 19C from the developing units 14K, 14Y, 14M, 14C. The toner has been charged through frictional action when it is formed into a thin layer. Further, during the developments for the respective colors, the developing rollers 19K, 19C, 19M, 19C are applied thereto with a negative voltage (developing bias) while they are rotated, and simultaneously, motors (which are not shown) which are exclusive to contact cams 20K, 20Y, 20M, 20C, respectively, are driven so as to displace a selected one of the developing units 14K, 14Y, 14M, 14C, for example, the black developing unit 14K in order to make the developing roller 19K into contact with the photosensitive belt 5. That is, in this embodiment, contact development using nonmagnetic one-component toner is used.

A part of the photosensitive belt 5 where a latent image is formed has a surface potential (bright potential) which is raised to a value in a range from −50 to −100V. Accordingly, an electric field directed from the photosensitive belt 5 to the developing rollers 19K, 19Y, 19M, 19C is generated by applying a negative potential of about −300 V to the developing rollers 19K, 19Y, 19M, 19K. As a result, coulomb force in a direction reverse to that of the electric field, that is, in the direction of the arrow A, acts upon the toner negatively charged, on the developing rollers 19K, 19Y, 19M, 19C. Thus, the toner sticks to a latent image part formed on the photosensitve belt. Meanwhile, since the outer surface potential (bright potential) of the photosensitive belt 5 in a part where no latent image is formed is −600 V, the electric field is produced in the direction from the developing rollers 19K, 19Y, 19M, 19C to the photosensitive belt 5 even though the developing bias is applied, and accordingly, the toner does not stick to the photosensitive medium.

It is noted that the above-mentioned process is the so-called nega/posi-process or inversion development process since a part where light is projected (that is, white), is stuck with toner (that is, black).

The photosensitive medium cleaning unit 16 is located being opposed to the photosensitive medium support roller 8, the photosensitive belt 5 being interposed between the photosenstive medium cleaning unit 16 and the photosensitive medium support roller 8, and accordingly, after image transfer from the photosensitive belt 5 onto the intermediate transfer medium 15, the cleaning unit 16 removes toner remaining on the photosensitive belt 5. The splicing 11 of the photosensitive belt 5 is inclined by an angle of about 3 to 5 deg. with respect to the scanning direction of the exposure light beam 8 so as to prevent an image from being disturbed by a shock which occurs when the splicing 11 passes by the photosensitive medium cleaning unit 16. Accordingly, the photosensitive medium cleaning unit 16 has no mechanism for engaging the cleaning unit with and disengaging it from the photosensitive belt 5. The discharger 17 is composed of a plurality of red LEDs which are arranged on a line, for removing a residual potential on the photosensitive belt 5.

Next, explanation will be made of the arrangement around the intermediate image transfer medium.

The intermediate image transfer medium 15 is composed of a stock pipe made of metal such as aluminum and having a diameter of, for example, about 200 mm, and a belt-like sheet made of resin or the like and wound around the stock pipe, and is adapted to be rotated by a drive motor (which is not shown) in a direction B which is a forward direction with respect to the turn-around direction A of the photosensitive belt 5 so as to synthesize monocolor images into a full color image.

The intermediate image transfer medium 15 is provided thereto with a means 21 for cleaning the image transfer medium 15, which is composed of a blade-like member made of rubber or the like. This cleaning means 21 is separated from the intermediate image transfer medium 15 when the synthetic image is formed on the intermediate image transfer medium 15, but is made into contact therewith during cleaning of thereof so as to remove toner which remains thereon without being transferred onto a recording medium 22 such as paper from thee image transfer medium 15. A detecting plate 23 for detecting a position of the intermediate image transfer medium is provided at a side surface of the latter. Further, there is provided a sensor 24 for detecting a position of an intermediate image transfer medium, that is, for detecting slits formed in the detecting plate 23 for detecting a position of the intermediate image transfer medium. Further, in order to form an image, one of the slits is selected by the sensor 24 for detecting the position of the intermediate image transfer medium, and the thus selected slit is used as a reference position for image formation.

Then, explanation will be made of how to determine the reference for image formation.

In the arrangement of the image forming apparatus shown in FIG. 1, it is designed that the circumferential length of the photosensitive belt 5 is equal to that of the intermediate image transfer medium 15. However, they can hardly be precisely equal to each other, and accordingly, their cyclic periods are slightly different from each other. Thus, if the mark 9 for detecting the photosensitive medium position is used as an image formation reference, even though toner images are formed always at one and the same position on the photosensitive belt 5, the toner images are offset from one another when they are superposed one over another on the intermediate image transfer medium 15. Meanwhile, if the image formation reference is obtained from the intermediate image transfer medium 15, the position of image formation on the photosensitive belt 5 gradually varies in accordance with a difference between their circumferential lengths. However, the synthetic image can be formed at one and the same position on the intermediate image transfer medium 15 Accordingly, the reference of image formation must be obtained on the intermediate image transfer medium 15.

Moreover, as has been already explained, no toner image can be formed on the splicing 11 which is present in the photosensitive medium 15, and accordingly, there would be such a case that the image forming mode cannot be taken even though a position of image formation is set at a suitable position on the intermediate image transfer medium 15. Accordingly, a slit in the plate 23 for detecting the position of the intermediate transfer medium, just after the photosensitive medium position detecting mark 9 is detected, can be selected as the reference of image formation. It is noted that the number of slits in the plate 23 for detecting a position of the intermediate transfer medium may be one in its principle, but in view of such a fact that first printing would be delayed in dependence upon a positional relationship between the photosensitive belt 5 and the intermediate image transfer medium 15, a plurality of slits are formed in the plate 23 for detecting a position of the intermediate transfer medium.

A density sensor 25 composed of a light emitting element and a light receiving element in combination is provided, for detecting a toner density on the intermediate image transfer medium 15. The density sensor 25 is connected at its light emitting side to a D/A converter (which is not shown) on which data are set so as to control current for changing the volume of light emission, and delivers its output at the light receiving side to an A/D conversion port (which is not shown) of a CPU.

Next, explanation will be made of the arrangements of a paper supply system and a fixing system.

Recording media 22 are fed one by one onto a sheet conveying path 28 from a recording medium cassette 26 by a paper feed roller 27.

An image transfer unit 29 which makes contact with the outer peripheral surface of the intermediate image transfer medium by a predetermined length is arranged. The image transfer unit 29 is adapted to transfer a synthetic image from the intermediate image transfer medium 15 onto a recording medium 22, and is composed of an image transfer belt 30 made of conductive rubber or the like in a belt-like shape, a transfer unit 31 for applying a transfer bias for the synthetic image on the intermediate image transfer medium 15 onto the recording medium 22, and a separator 32 for applying a bias so as to prevent the recording medium 22 from electrostatically sticking to the intermediate image transfer medium 15 after the synthetic image is transferred onto the recording medium 22. Downstream of the transfer unit 29 in the conveying direction, a fixing unit 33 composed of a heat roller 34 incorporating a heat source and a pressing roller 35 is arranged. In this fixing unit 33, the synthetic image transferred onto the recording medium 22 is fixed on the recording medium 22 by pressure and heat which can be obtained by clamping between the heat roller 34 and the pressing roller 35 on rotation. Thus, a color image can be obtained.

Including the arrangements as mentioned above, an electronic photography is in general sensitive to environmental variation. For example, the gradation characteristic varies with time in accordance with an increase in temperature in the apparatus. In an electronically photographing apparatus for outputting full colors, it is important to ensure tones and a gray balance in synthesis of three primary colors, that is, cyan, magenta and yellow, various approaches have been taken.

In an electronic photographing apparatus in this embodiment, density compensation is carried out, for example, at an initialization stage upon energization of a power source.

At first the initialization will be detailed.

When the power source is energized, whether hardware including a memory, and items required for image formation, such as the developing units 14K, 14Y, 14M, 14C and the photosensitive belt 5, are mounted or not is checked, and further, detection of initial jamming and the like is carried out. If no abnormal matter is present, the heater in the heat roller 34 in the fixing unit 33 is energized, waiting until the temperature of the heat roller reaches a predetermined value, which is a temperature at which the toner is softened, that is, about 100 deg.C. When the outer surface of the heat roller comes up to the predetermined temperature, the initialization is started.

During initialization, whether a drive motor (main motor) for the photosensitive belt 5 and the intermediate image transfer medium 15, a drive motor for the developing roller 19, the scanner motor for rotating the polygon mirror in the exposure optical system, a sheet conveying motor are started or not, and whether a servo system is normally operated or not are confirmed. Then, the charger 12 and the discharger 17 are energized while at least the main motor is driven, so as to initiate the initialization of the surface potential of the photosensitive belt 5.

Next, the positions of the components are confirmed. First, the positions of the developing units 14K, 14Y, 14M, 14C are checked, and if, for example, the developing unit 14K is extended to its developing position, a motor exclusive thereto is driven to return the contact cam 20K to its standby position. Further, the position of the cleaning unit 21 for the intermediate image transfer medium is checked, and if it is separated from the intermediate image transfer medium 15, it is made into contact with the latter. Normally, the cleaning unit 21 for the intermeidate image transfer medium makes contact with the intermediate image transfer medium 15 so s to be held in the cleaning condition, but it is separated therefrom only when monocolor images are synthesized. Of course, in this process, even though instructions are issued for returning the above-mentioned components to their standby positions, if they are not returned, the elecrtonically photographing apparatus interrupts its initialization, and indicates error message on a display panel or the like.

Next, initialization for the developing units 14K, 14Y, 14M, 14C is carried out. At first, the contact cam 20C is rotated so as to move the developing unit 14C toward the photosensitive belt 5. Further, it is confirmed that the developing unit 14C is fixed at its developing position, and thereafter, the developing roller 19 is rotated. At this time, since no developing bias is applied (no latent image has yet been formed even though the developing bias is applied), and accordingly, the toner does not stick to the photosensitive belt 5.

The detection of remaining quantities of toner in the developing units 14K, 14Y, 14M, 14C is carried at their developing position.

A light beam from an external light emitting element is introduced through transparent lenses attached to opposite side parts of the developing unit 14C. If the light beam is detected by a light receiving element provided on the side remote from the light emitting element, it is determined that the quantity of toner is insufficient. The light emitting element and the light receiving element are set on one and the same optical axis, and the optical axis can pass through the lens parts when the developing unit 14C is located at its developing position. It is noted that the lenses are periodically cleaned by wipers attached to an agitating means in the developing unit 14C, and accordingly, the lenses can be prevented from being contaminated with the toner. Since the cleaning members for the lenses are connected to the rotational drive of the developing roller 19C, and accordingly, it is required to rotate the developing roller 19C when the remaining quantity of toner is detected. Further, in such detection of a quantity of remaining toner, when the developing unit 14C is located at its standby position, that is, the contact cam 20C is located at its standby position, whether the developing unit 14C is present or not can be checked.

Now, after the developing roller 19C is rotated by a predetermined time, if the result of the detection of a quantity of remaining toner is not abnormal, the contact cam 20C is again rotated so as to return the developing unit 10C to its standby position. Thus, the initialization for the developing unit has been completed.

Subsequently, the developing units 14M, 14Y, 14K are successively initialized in that order. It is noted that this order of initialization of the developing rollers is caused by the fact that there is present such a risk that toner is mixed among the developing units 14C, 14M, 14Y, 14K if the developing units are initialized in a direction opposite to the driven direction in the case of, for example, erroneous operation of a high voltage power source since the developing belt 5 is turned around in the direction of the arrow A.

After the initialization for all the developing units 14C, 14M, 14Y, 14K is completed, all drive sources other than the sheet conveying drive motor as a drive source of the heat roller 34 are stopped while the charger 12 and the discharger 17 are deenergized, and then, warm-up is carried out until the heat roller 34 in the fixing unit 33 comes up to a predetermined temperature at which the fixing can be made. Further, the density compensation is carried out in this warm-up period.

Next, explanation will be detailed of the operation of density compensation.

Figure 2:
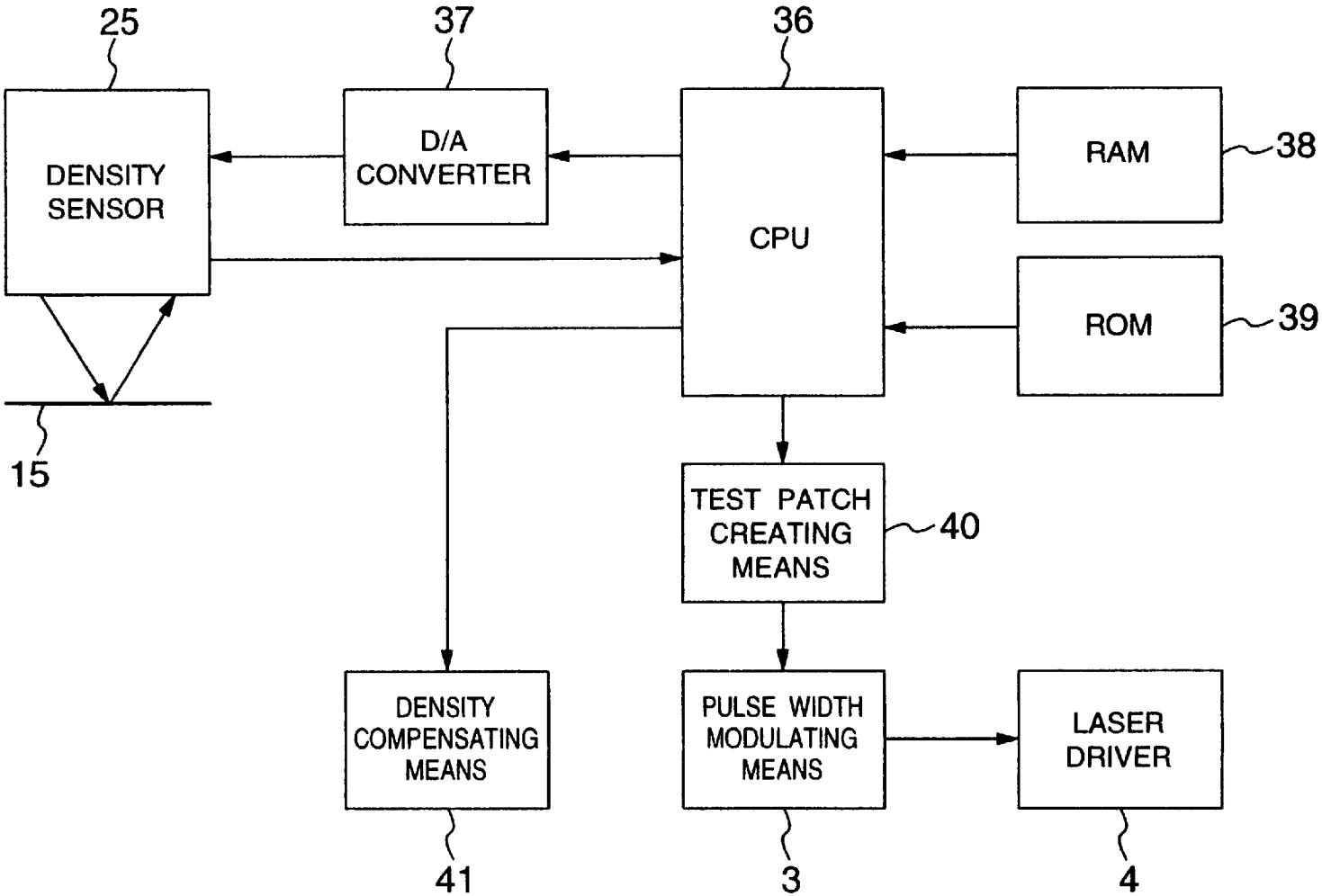
FIG. 2 is a block diagram illustrating a density compensating system in the image forming apparatus shown in FIG. 1.

Referring to FIG. 2, the density sensor 25 for detecting toner density of a toner image on the intermediate image transfer medium 15, is connected to the CPU 36 incorporating the A/D converter and to the D/A converter 37. The CPU 36 is connected to a RAM 36, a ROM 39 stored therein with a program carried by the CPU 36 and a test patch creating means 40. Further, the CPU 36 is connected to a density compensating means 41 for carrying out density compensation in accordance with a value of output from the density sensor 25. It is noted that the test patch creating means 40 is connected to a pulse width modulating means 3 for pulse-width-modulating an image signal, and the pulse width modulating means 3 is then connected to a laser driver 4 for driving the exposure light beam.

It is noted here that the density sensor 25 is an optical sensor arranged being opposed to the intermediate image transfer medium 15, and is composed of the light emitting element and the light receiving element. Further, the CPU 36 is adapted to change a forward current running through the light emitting element in the density sensor 25 by setting a numerical value on the D/A converter 37 so as to control the light volume. A value which can be set on the D/A converter 37 has eight bits, that is, a value from 0 to 255 can be set. It is noted that an output from the density sensor 25 is inputted to the A/d conversion port of the CPU 36.

When the electronically photographing apparatus comes into the warm-up session, the main motor (which is not shown) is started so as to drive the photosensitive belt 5 and the intermediate image transfer medium 15. Incidentally, the high voltage power source for the charger 12 and the like has not be energized at this time. After the photosensitive belt 5 and the intermediate image transfer medium 15 are driven at their predetermined speeds through the energization of the main motor, the intermediate image transfer medium 15 is moved by at least one turn in order to clean the intermediate image transfer medium.

First, at a fist step of the density compensation, the density sensor 25 is tuned up so as to restrain unevenness in the characteristic of the density sensor 25 for every apparatus. Specifically, a volume of light emission of the density sensor 25 is determined. Explanation will be hereinbelow made of the tuning of the density sensor 25.

After the intermediate image transfer medium 15 is completely cleaned, a desired value for adjusting the surface density of the intermediate image transfer medium is set to, for example, 1.25 V at an analog level, that is, "64" (=1.25V/5.00V×255) in the form of data obtained after A/D conversion. The CPU 36 successively sets values of eight bit in an ascending order on the D/A converter 37 so as to compare an output from the density sensor 25 with the desired adjusting value. Further, when the output from the density sensor 25 is coincident with the desired adjusting value, a set value of light emission is determined, which is stored in the RAM 38.

After completion of the tuning of the density sensor 25, a second step of the density compensation is initiated, at this second step, an averaged value of the surface density over one turn of the intermediate image transfer medium 15, that is, a highlight reference is measured, and the result thereof is stored in the RAM 38.

After the acquirement of the highlight reference is completed, a third step of the density compensation is initiated. At the third step, one or more of test patches are formed on the intermediate image transfer medium 15, and toner densities thereof are detected for every color. Then, the toner densities of the test patches are obtained by using the highlight reference. It is noted that, particularly in the detection of the density of a noncolor component, a toner density may be directly obtained from a test patch formed on the photosensitive belt 5.

Figure 3:
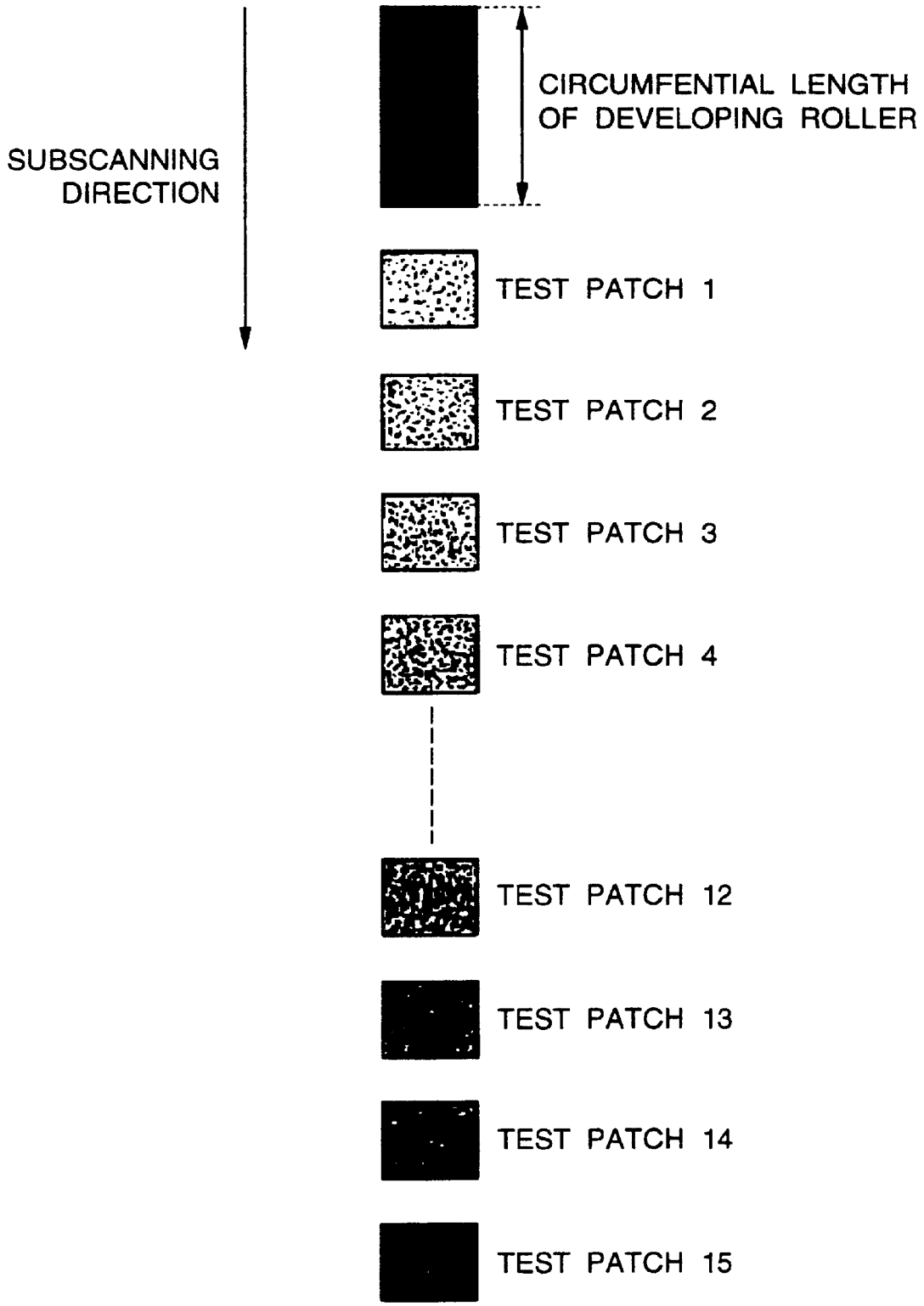
FIG. 3 is a view for explaining test patches for compensating a density, which are obtained by the image forming apparatus shown in FIG. 1.

The test patches used at the third step are shown in FIG. 3.

The test patches are formed by a test patch creating means 40, being based upon instructions from the CPU 36 when the power source is energized, or suitable conditions have been set up in order. Further, in order that the image deterioration can hardly be appreciated visually even though the pattern zone is physically deteriorated due to the formation of the one and the same pattern by several times, the test patches are formed in one end part of the image zone. Further, the number of the test patches is optional, image data have been set in order to form several different density patterns. In this case, the test patches having 15 tones in total are formed, being settled in the circumferential length of the intermediate imager transfer medium 15.

In this embodiment, as shown in FIG. 13, the test patches are formed after the toner corresponding to the one turn of the developing roller is consumed. With this arrangement, since no test patches are formed with toner having a charged value which is raised from that in the normal condition, it is possible to prevent the densities of the test patches in the leading end part from lowering.

Figure 4A:
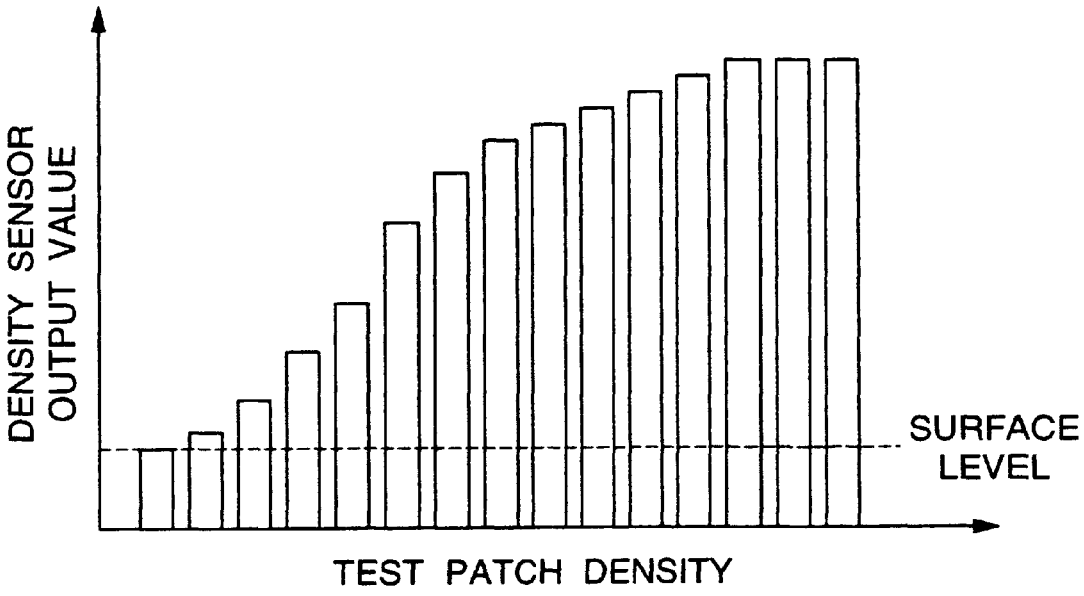
FIG. 4*a* is a graph for showing a relationship between densities of test patches having coloring components and outputs of a density sensor.
Figure 4B:
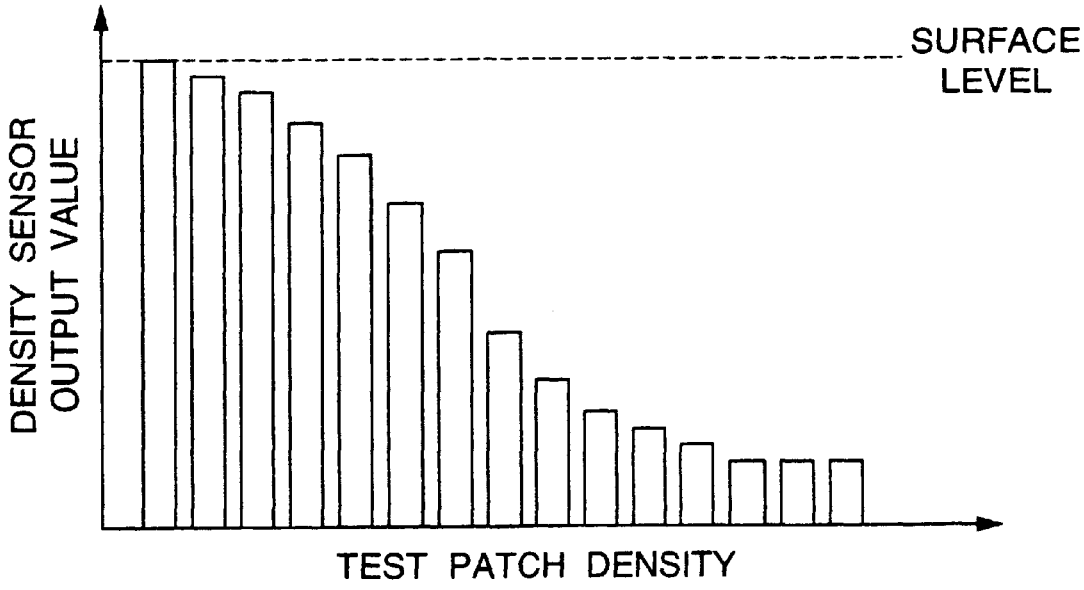
FIG. 4*b* is a view showing a relationship between densities of test patches having no coloring component and outputs of the density sensor.

Referring to FIGS. 4*a* and 4*b*, next, explanation will be made of general characteristics of color component toner and noncolor component toner in the test patches formed on the intermediate image transfer medium 15 after they are detected by the density sensor 25.

FIG. 4*a* and 4*b* show examples of outputs from the density sensor 25 for density compensating test patches as color components (cyan, magenta and yellow) and noncolor component black), respectively.

In the case of the color components, the output of the density sensor 25 increases as the density of the test patches increases. Precisely, the characteristics of different colors are different from one another, but substantially no difference is appreciated in view of such a fact that the output of the density sensor 25 increases monotonously as the pattern density increases.

Meanwhile, when a pattern having noncolor component is detected in the same condition, the output of the density sensor 25 decreases monotonously as the pattern density increases. Remarkable feature is such that the values of the color components and the noncolor component change in different directions on the opposite sides of the center of the graph, that is, the surface density level of the intermediate image transfer medium 15 as the pattern density increases.

After the completion of the density compensation at the second step, latent images of the test patches as shown in FIG. 3 are formed on the photosensitive belt 5 by the test patch creating means 40. The components required for the formation of images have been already started, that is, high voltages and the like have been prepared, and at this stage, the preparation for the formation of images has been completed. After a predetermined time elapses, the black developing unit 14K is made into contact with the photosensitive belt 5 so as to manifest the test patches. The manifested black test patches are transferred onto the intermediate image transfer medium 15, and are shifted to the density sensor 25.

At this time, the CPU 36 sets a volume of light emission for the density sensor 25 on the D/A converter 37, and accordingly, it initiates reading of the output of the density sensor 25. The output of the density sensor 25 is read at a predetermined sampling intervals by the CPU 36. The reading is carried out for all image zones, and the CPU 36 stores at once the results of the reading in the RAM 38.

Subsequently, test patches for cyan, magenta and yellow are successively formed on the intermediate image transfer medium 15 with the use of the same image data as that of the back test patches, and the results of the reading thereof are stored in the RAM 38, similar to the black test patches.

As mentioned above, the cleaning unit for the intermediate image transfer medium is made into contact with the intermediate image transfer medium 15, and accordingly, the intermediate image transfer medium 15 is always cleaned so that the density sensor can read test patches for every color.

Thus, the results of the detection of the densities of the test patches have been obtained from the highlight reference and the outputs from the density sensor 25, and have been stored in the RAM 38. However, these data are only outputs of the density sensor 25, which are simply obtained at time sequences, the electronically photographing apparatus process the data by stopping all operations of the motors, the charger and the like after the formation of the test patches and the reading thereof are completed.

Data in the RAM 38 are all based upon the detection of the one and the same slit in the intermediate image transfer medium detection board 23, the point of the initiation of the test patches comes to one and the same position on the intermediate image transfer medium 15. Further, since the time from the detection of the slit in the detection board 23 for the intermediate image transfer medium to the initiation of the reading of the output of the density sensor 25 by the CPU 36, is fixed, the results of the reading corresponding to respective patch positions can be easily obtained.

Accordingly, values of ten points in every test patch are summed so as to obtain an average value which is set as a value of the one test patch. Thus, the toner densities of the patches for noncolor component and of the test patches of the color components can be obtained.

As mentioned above, the density compensation is carried out, being based upon the thus obtained toner densities of the test patches. As to the density compensation, there can be used γ-compensation through which the γ-characteristic of the electronically photographing apparatus is set to be linear, compensation through which the density in certain image data is set to be uniform, or the like. Further, a laser pulse width, a laser power, a grid potential, a developing bias, a first transfer bias or the like may be used as an object to be controlled.

Further, as mentioned above, in this embodiment, since the test patches are formed after the toner corresponding to the circumferential length of the developing roller has been consumed, the test patches with no lowering of density and no unevenness of density can be always formed, thereby it is possible to carry out the density compensation for always obtaining an image having a high degree of quality.

Second Embodiment

Figure 5:
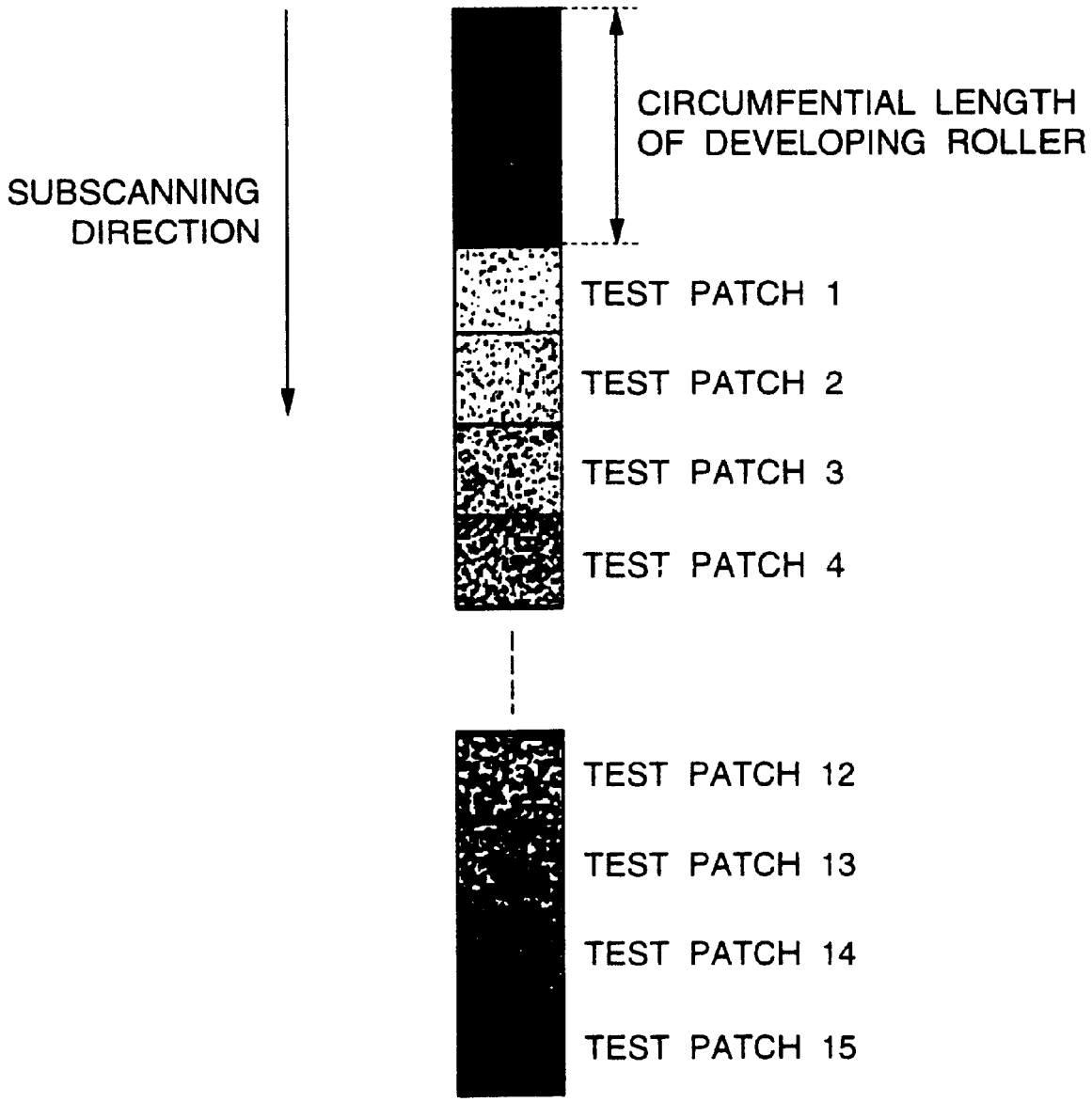
FIG. 5 is a view for explaining test patches for compensating a density, which are obtained by an image forming apparatus in a second embodiment of the present invention.

Referring FIG. 5 which is a view for explaining test patches for density compensation, which can be obtained an image forming apparatus in a second embodiment of the present invention, the test patches in this embodiment, the test patches are successively formed by means of the test patch creating means with no gaps therebetween.

The test patches, in this embodiment, can be formed, being made into close contact with one another with no gaps therebetweeen as shown, by the test patch creating means. Further, if the test patches are formed in this way, no toner having a charged value which is raised from a normal charged value can be eliminated in the test patches. Accordingly, the test patches with no uneven density can be formed, thereby it is possible to always obtain a satisfactory image while the density compensation is carried out.

Third Embodiment

Figure 6:
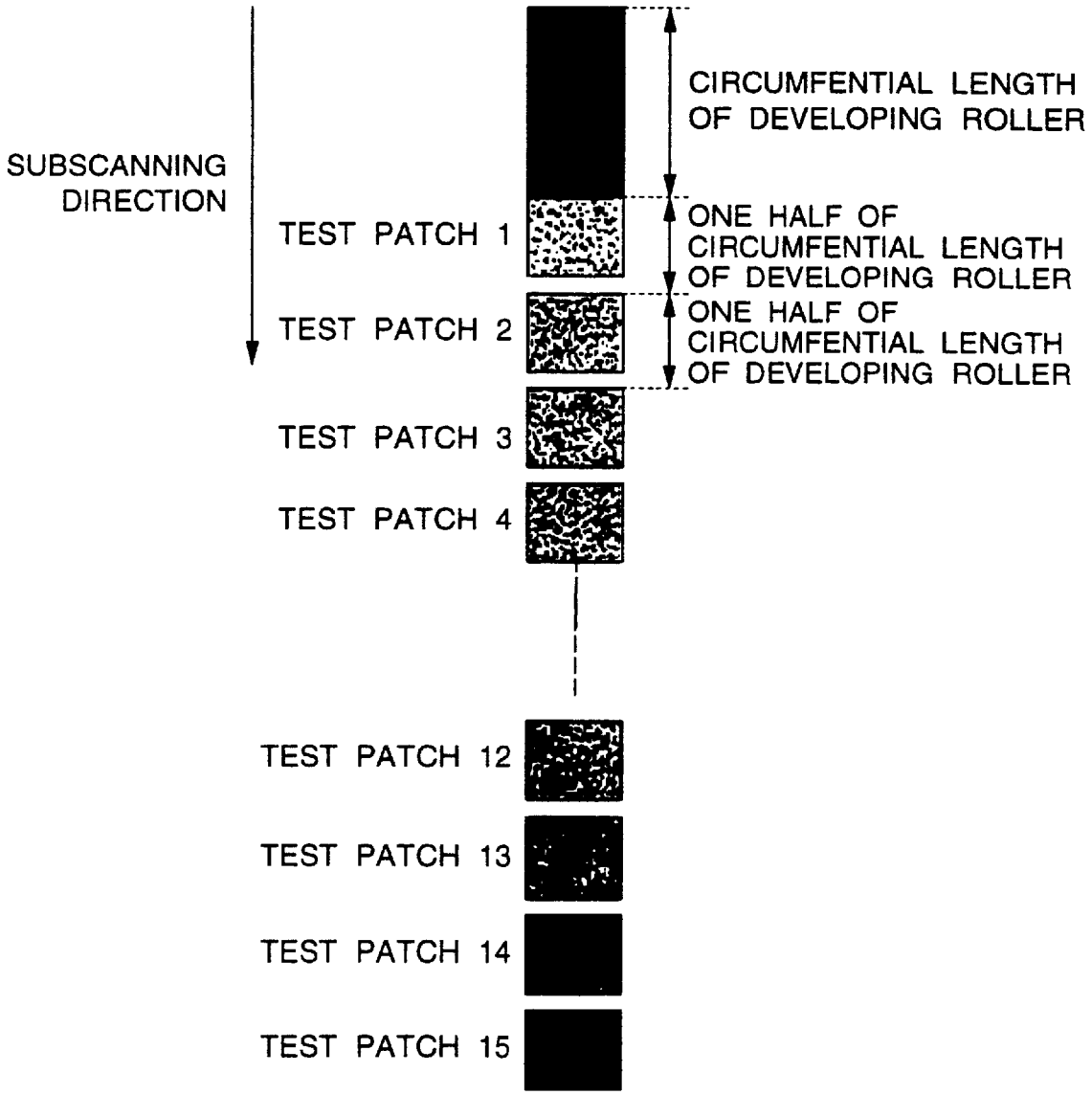
FIG. 6 is a view for explaining test patches for compensating a density, which are obtained by an image forming apparatus in a third embodiment of the present invention.
Figure 7:
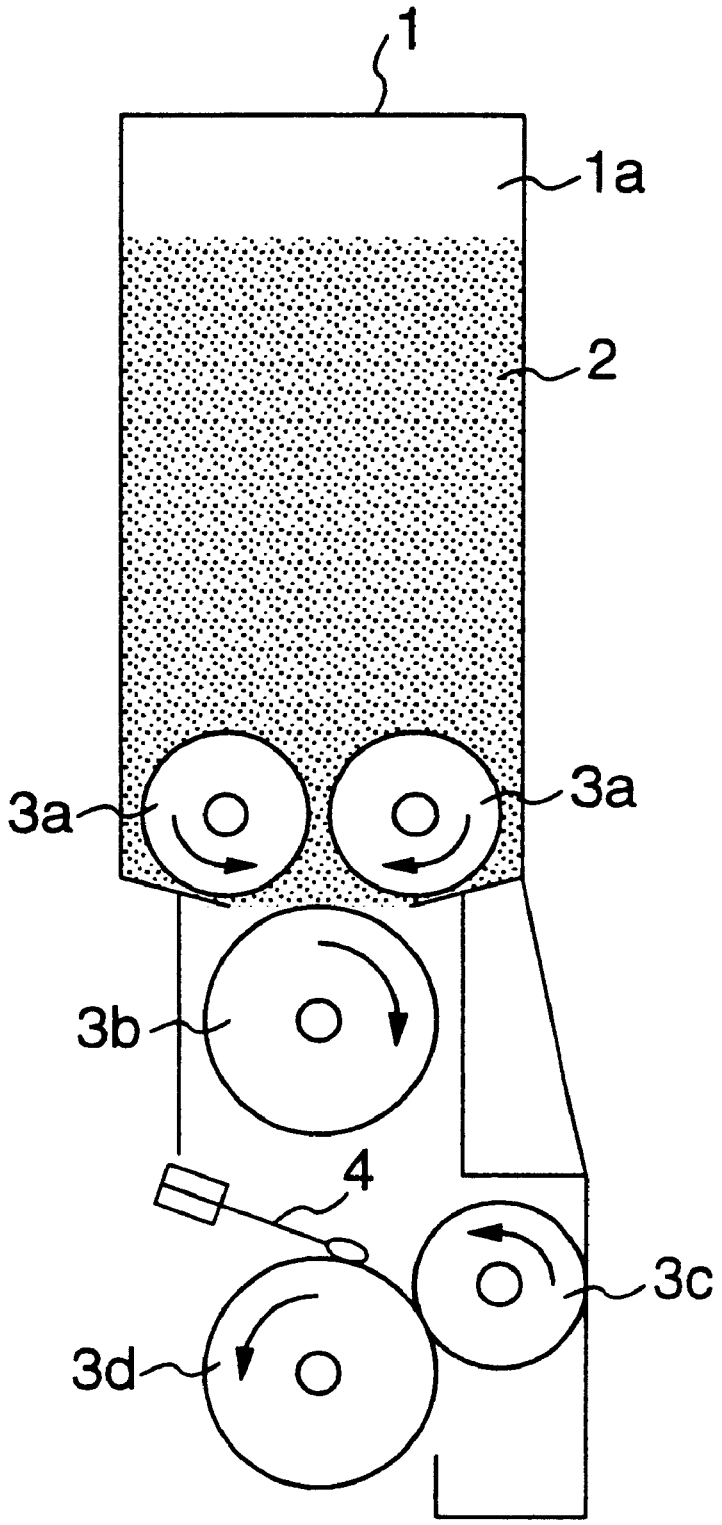
FIG. 7 is a sectional view illustrating a conventional developing means.
Figure 8:
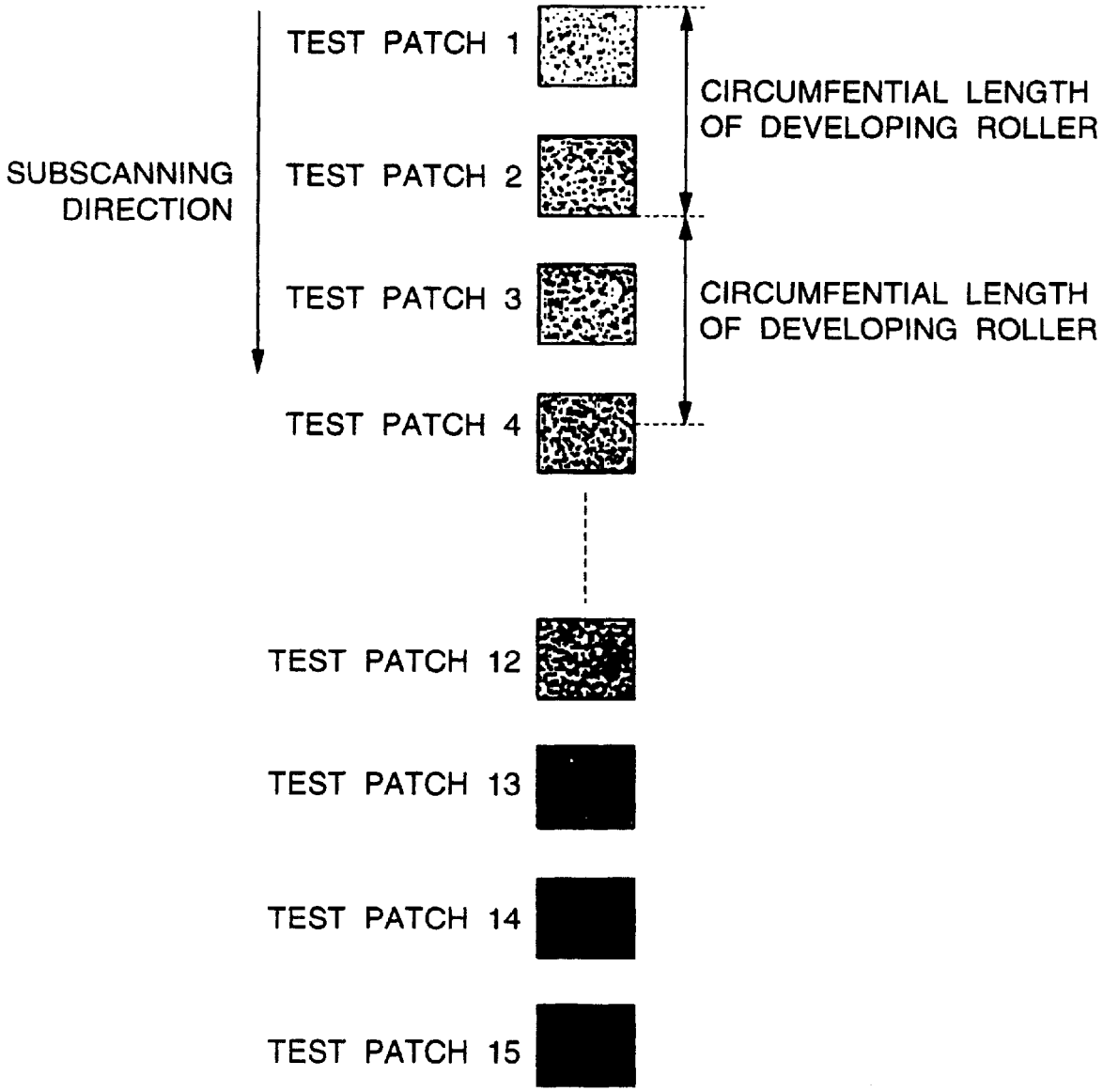
FIG. 8 is a view for explaining conventional test patches for compensating densities.
Figure 9:
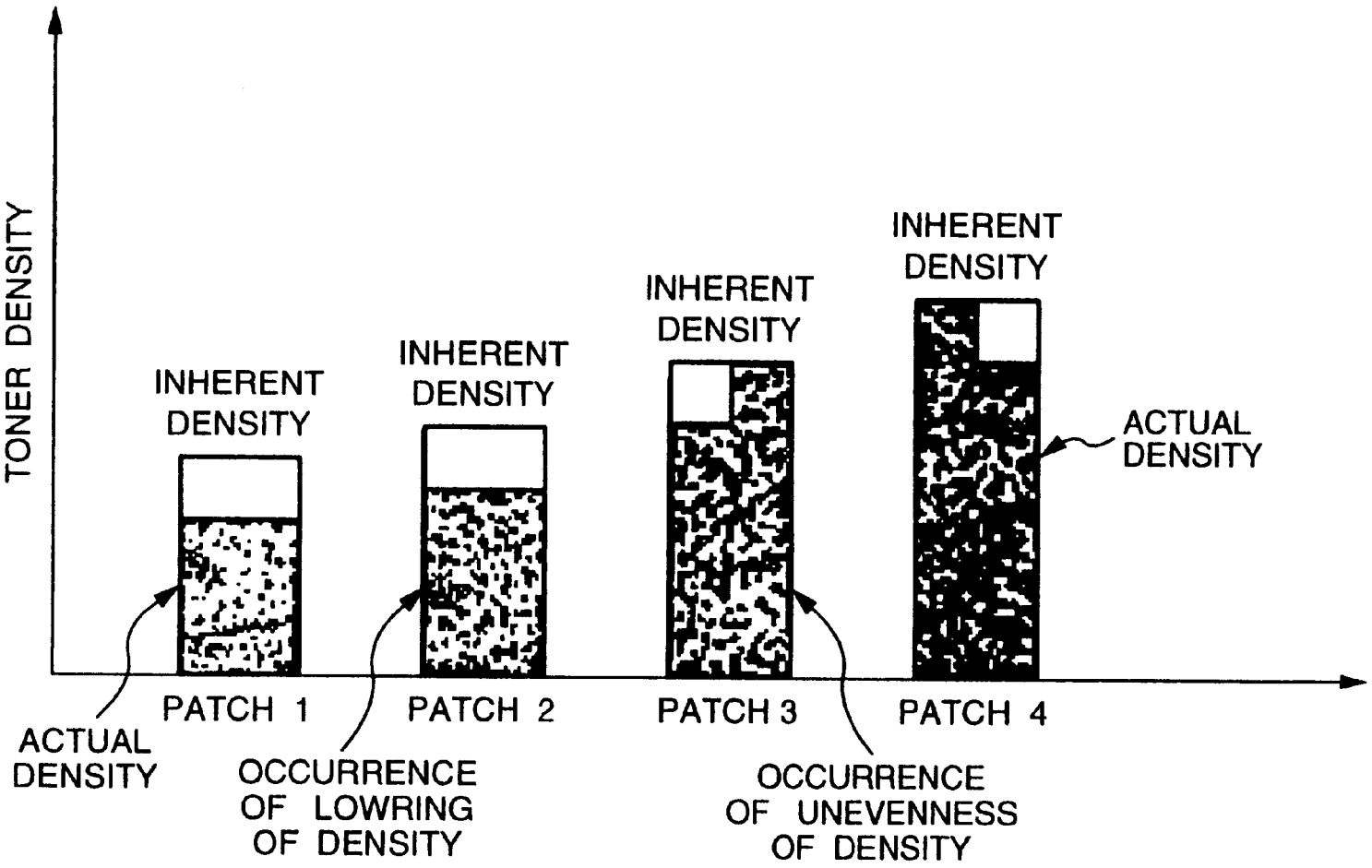
FIG. 9 is a view showing a relationship between the conventional test patches and toner densities.

Referring to FIG. 6, which is a view for explaining test patches for density compensation, these patches can be obtained by an image transfer apparatus in a third embodiment of the present invention. In this embodiment, the test patches are formed by the test patch creating means in such a way that adjacent test patches are spaced from one another, the distance between the leading ends of the adjacent test patches is set to be equal to one-half of the circumferential length of the developing roller.

Even though the test patches are formed at the above-mentioned intervals, since no toner having a charged value which is increased from the normal charged value is present in the test patches, it is possible to form test patches with no unevenness in the toner density, thereby it is possible to always carry out density compensation with which a satisfactory image can be obtained. The distance between the leading ends of the adjacent test patches should not be limited to one-half of the circumferential length of the developing roller, but may be set to 1/n thereof (where n is integer).

Further, as in the above-mentioned explanation, it should be noted that data of the test patches for density compensation should not be limited to multi-level data.

As mentioned above, according to the present invention, the test patches are formed after toner having a charged value which is increased from a normal value has been consumed, thereby it is possible obtain an effective result such that the test patches having no lowering of the density and unevenness of density can be formed.

Thus, it is possible to obtain such an effective result that an image having satisfactory quality can be obtained.

What is claimed is:

1. An image forming apparatus comprising:

a test patch creating means for generating image data for at least one test patch;

an image bearing medium on which a latent image of the test patch is formed, said latent image being based upon the image data generated by said test patch creating means;

a developing means including a developing roller for applying toner onto said latent image so as to manifest said latent image in order to obtain a toner image;

a density sensor for detecting a toner density of the toner image of the manifested test patch; and a density compensating means for providing density compensation, said density compensation being based upon an output value of said density sensor;

wherein said test patch creating means creates said test patch after the toner corresponding to a circumferential length of said developing roller is consumed.

2. An image forming apparatus as set forth in claim 1, wherein said test patch creating means generates image data for continuously forming a plurality of test patches with no gaps therebetween.

3. An image forming apparatus as set forth in claim 1, wherein said test patch creating means generates image data for creating a plurality of test patches at such intervals that a distance between leading ends of test patches of the plurality of test patches which are adjacent to each other is set to 1/n (where n is an integer) of the circumferential length of said developing roller.

* * * * *